US010060608B2

(12) United States Patent
Lee et al.

(10) Patent No.: US 10,060,608 B2
(45) Date of Patent: Aug. 28, 2018

(54) DETACHABLE LED LIGHTING DEVICE

(71) Applicant: KMW INC., Hwaseong, Gyeonggi-do (KR)

(72) Inventors: Tai-Woo Lee, Gyeonggi-do (KR); Duk-Yong Kim, Gyeonggi-do (KR)

(73) Assignee: GIGATERA INC., Hwaseong-si (KR)

( * ) Notice: Subject to any disclaimer, the term of this patent is extended or adjusted under 35 U.S.C. 154(b) by 126 days.

(21) Appl. No.: 15/171,449

(22) Filed: Jun. 2, 2016

(65) Prior Publication Data

US 2016/0273745 A1 Sep. 22, 2016

Related U.S. Application Data

(63) Continuation of application No. PCT/KR2014/011713, filed on Dec. 2, 2014.

(30) Foreign Application Priority Data

Dec. 2, 2013 (KR) ..... 10-2013-0148239

(51) Int. Cl.
*F21V 21/00* (2006.01)
*F21V 21/08* (2006.01)
(Continued)

(52) U.S. Cl.
CPC ..... *F21V 21/08* (2013.01); *F21K 9/175* (2013.01); *F21V 3/00* (2013.01); *F21V 7/0008* (2013.01);
(Continued)

(58) Field of Classification Search
CPC ..... F21V 21/025; F21V 21/088; F21V 21/08; F21K 9/27–9/278; F21S 8/046
See application file for complete search history.

(56) References Cited

U.S. PATENT DOCUMENTS

2013/0002164 A1* 1/2013 Galluccio ..... F21V 19/00 315/294
2013/0087722 A1 4/2013 Brown
(Continued)

FOREIGN PATENT DOCUMENTS

KR 10-2010-0001248 A 1/2010
KR 10-0974942 B1 8/2010
(Continued)

OTHER PUBLICATIONS

Supplementary European Search Reporting dated May 3, 2017 in corresponding EP Application No. 14868225.5.

*Primary Examiner* — Sean Gramling
(74) *Attorney, Agent, or Firm* — Mintz Levin Cohn Ferris Glovsky and Popeo, P.C.; Kongsik Kim; Jhongwoo Jay Peck

(57) ABSTRACT

The present invention relates to a detachable LED lighting device, comprising: a lighting module unit which emits light by receiving a power supply, the lighting module unit comprising a substrate including a plurality of LEDs; a connector unit coupled to the lighting module unit, the connector unit having a hitch protrusion on the upper part and having a lower connector for supplying power to the substrate; and a frame unit provided with a connector and a power connector, the connector fixed by being hitched to the hitch protrusion of the connector unit that is inserted into the bottom surface, and the power connector supplying power from an embedded power supply unit to the lower connector. The present invention comprises a frame unit having a power supply unit embedded therein and a lighting module unit which can be easily separated from the frame unit by manipulation of a push button exposed to both ends, with the both ends being fitted and fixed into the frame unit so that
(Continued)

the lighting module unit can be more easily detached, thereby reducing the time and cost required for maintenance.

12 Claims, 13 Drawing Sheets

(51) Int. Cl.

| | |
|---|---|
| ***F21V 7/00*** | (2006.01) |
| ***F21V 19/00*** | (2006.01) |
| ***F21V 23/06*** | (2006.01) |
| ***F21K 99/00*** | (2016.01) |
| ***F21V 3/00*** | (2015.01) |
| ***F21V 23/02*** | (2006.01) |
| *F21Y 103/10* | (2016.01) |
| *F21Y 115/10* | (2016.01) |
| *F21S 8/06* | (2006.01) |
| *F21Y 101/00* | (2016.01) |

(52) U.S. Cl.
CPC ..... *F21V 19/003* (2013.01); *F21V 19/004* (2013.01); *F21V 23/02* (2013.01); *F21V 23/06* (2013.01); *F21S 8/06* (2013.01); *F21Y 2101/00* (2013.01); *F21Y 2103/10* (2016.08); *F21Y 2115/10* (2016.08)

(56) References Cited

U.S. PATENT DOCUMENTS

| | | | | |
|---|---|---|---|---|
| 2013/0141904 | A1 | 6/2013 | Verfuerth et al. | |
| 2013/0294059 | A1* | 11/2013 | Galluccio ..... | F21V 7/0008 362/218 |

FOREIGN PATENT DOCUMENTS

| | | | |
|---|---|---|---|
| KR | 10-2011-0049313 | A | 5/2011 |
| KR | 10-1198695 | B1 | 11/2012 |
| WO | 2010/071295 | A2 | 6/2010 |
| WO | 2014-202666 | A1 | 12/2014 |

* cited by examiner

DETACHABLE LED LIGHTING DEVICE

CROSS-REFERENCE TO RELATED APPLICATION

This application is a continuation of International Application No. PCT/KR2014/011713 filed on Dec. 2, 2014, which claims priority to Korean Application No. 10-2013-0148239 filed on Dec. 2, 2013. The applications are incorporated herein by reference.

TECHNICAL FIELD

The present invention relates to a detachable LED lighting device, and, more particularly, to an LED lighting device in which a lighting module can be easily coupled or detached as necessary.

RELATED ART

In general, lighting devices that use an LED as a light source have been developed in consideration of the problems of conventional lighting means, such as high power consumption, a short life, or the like.

The conventional lighting devices, which use LEDs as a light source, adopts a plurality of LED lighting modules, so if one lighting module does not work, there were efforts to make a configuration to replace the same.

For example, Korean Patent No. 10-0974942 (LED streetlights, registered on Aug. 3, 2010) discloses an LED streetlight that adopts a pair of lamp housings to enable assembly and disassembly into parts so that maintenance is easy and maintenance costs can be reduced.

However, although the conventional LED lighting devices use a plurality of lighting modules to enable partial replacement, a bracket is used, which is coupled, in common, to the side portion of each lighting module. Korean Patent No. 10-0974942 above shows the configuration that also includes a front bracket, a rear bracket, and two side brackets, which are coupled to each other along the edge of a pair of lamp housings to form a frame of a rectangular shape.

In such a configuration, in order to replace one lamp housing, all or some of the brackets are required to be disassembled, which takes a long time. In particular, since the lamp housing is heavy, it is very hard for one worker to perform the disassembly, considering that the streetlight requires a high place work.

In addition, in the case where the illuminance is required to be changed by changing the number of LED lighting modules according to a user's request, the conventional lighting device, which uses the fixing brackets, requires a new design and manufacture to conform to the same, and thus, it is impossible to immediately respond to the user's request.

SUMMARY

In order to address the problems above, the present invention provides a detachable LED lighting device by which one worker can easily perform the replacement of the lighting module for each unit.

In addition, the present invention provides a detachable LED lighting device in which the number of lighting modules can be easily changed in order to immediately meet the user's request.

A detachable LED lighting device, according to the present invention, may include: a lighting module unit that includes a substrate having a plurality of LEDs, and that emits light according to the supply of power; a connector unit that is coupled to the lighting module unit and provides a hitch protrusion on the upper portion, and that adopts a lower connector for supplying power to the substrate; and a frame unit that has a connection opening through which the hitch protrusion of the connector unit is inserted from the bottom and then is fixed by being hitched, and that has a power connector for supply power to the lower connector from an embedded power supply unit.

The detachable LED lighting device of the present invention may include: a frame unit that has a power supply unit embedded therein; and a lighting module unit that is fitted and fixed to the frame unit at both ends thereof, and that is easily separated from the frame unit by manipulation of a pressing button that is exposed to the both ends so that the lighting module unit can be more easily coupled and detached, thereby reducing the time and cost required for maintenance.

In addition, the detachable LED lighting device of the present invention may easily change the number of lighting module units, which are mounted on the frame unit, according to the illuminance requested by the user in order to thereby enhance the user's convenience and in order to thereby provide versatility by which the lighting device of the same design can be applied for various uses.

DETAILED DESCRIPTION

Figure 1:
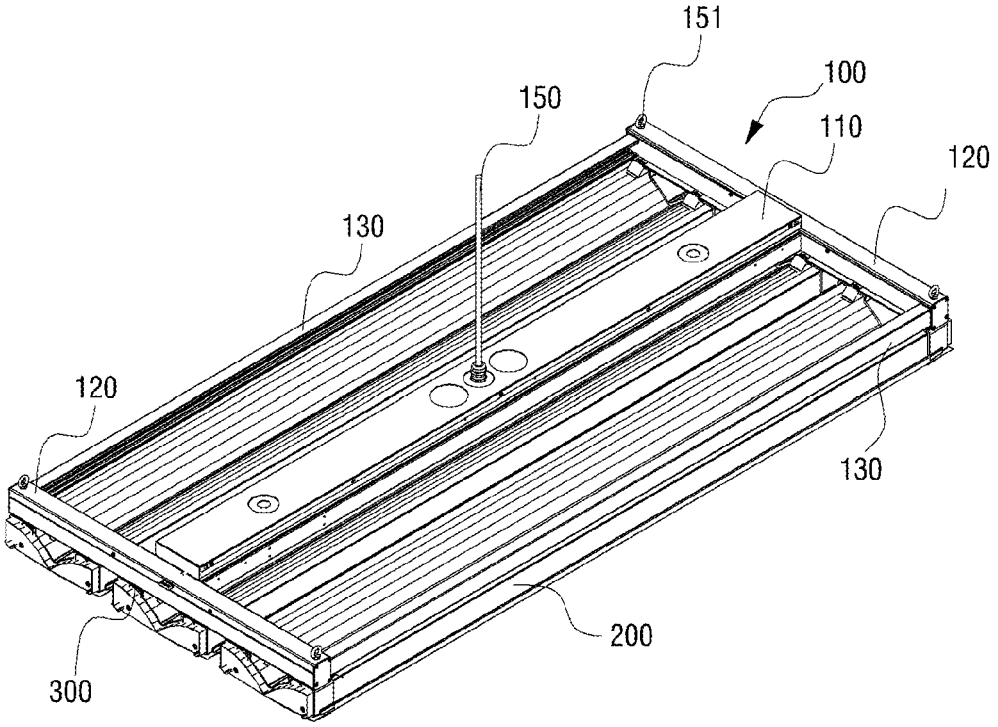
FIG. 1 is a perspective view showing the assembled state of a detachable LED lighting device, according to a preferred embodiment of the present invention.

Hereinafter, a detachable LED lighting device of the present invention will be described in detail with reference to the accompanying drawings. FIG. 1 is a perspective view showing the assembled state of a detachable LED lighting device, according to a preferred embodiment of the present invention, and FIG. 2 is a partially exploded perspective view of FIG. 1.

Figure 2:
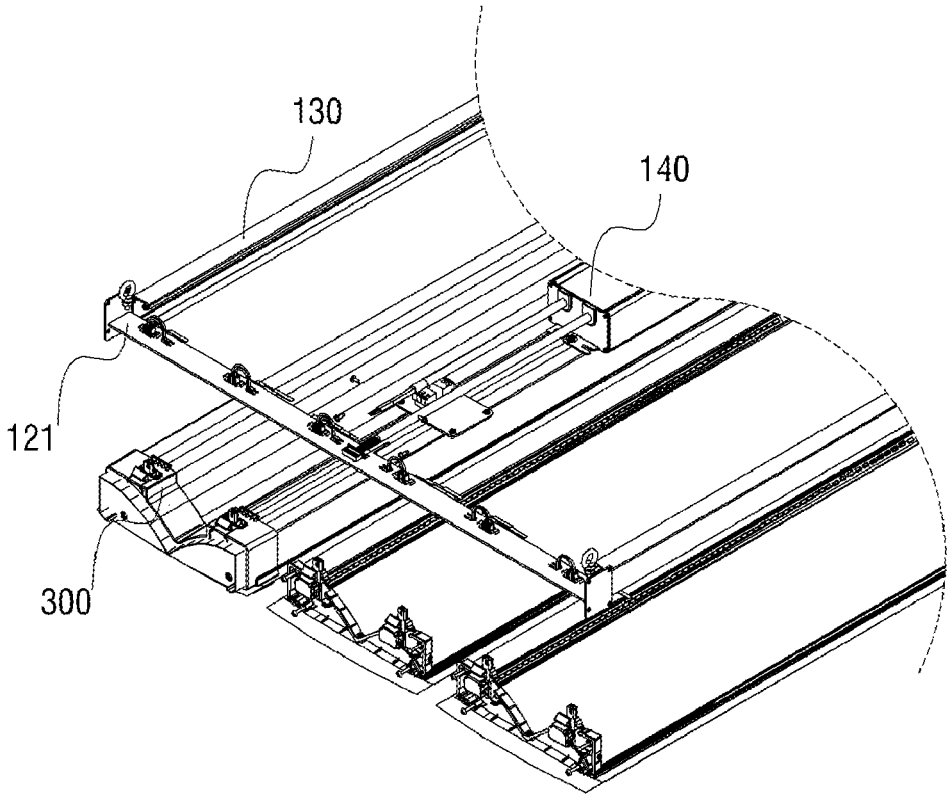
FIG. 2 is a partially exploded perspective view of FIG. 1.

Referring to FIGS. 1 and 2, the detachable LED lighting device, according to a preferred embodiment of the present invention, is configured to include: a frame unit 100 that has a power supply unit 140 mounted therein, and that provides a plurality of power connectors 124 for supplying power of the power supply unit 140; and a connector unit 300 that is coupled to both ends of a lighting module unit 200, and that fixes both ends of the lighting module unit 200 to the bottom surface of the frame unit 100 by a tight fit while being connect to the power connector 124 in order to thereby supply power to the lighting module unit 200.

Hereinafter, the configuration and operation of the detachable LED lighting device described above, according to a preferred embodiment of the present invention, will be described in more detail.

First, it is preferable to use the lighting module unit 200 that has a shape of a long bar extended in one direction, but the present invention is not limited to a specific configuration of the lighting module unit 200.

The frame unit 100 may be extended in the longitudinal direction of the lighting module unit 200, and may include a central frame 110 in which the power supply unit 140 is embedded; a connection frame unit 120 that is coupled such that each central portion is positioned at both ends of the central frame 110, and that has a plurality of power connectors 124 for supplying power of the power supply unit 140, which are provided therein; and a pair of support frames 130 that connect the both ends of the connection frame unit 120 to each other.

As it will be described in detail later, a connection opening is provided at the bottom of the connection frame unit 120, and the connector unit 300, which is coupled to both ends of the lighting module unit 200, is partially inserted into the connection opening and then is fixed. The detailed configuration thereof will be described later.

A wiring substrate 121 that receives power from the power supply unit 140 is provided inside the connection frame unit 120, and a plurality of power connectors 124 are provided, which include electric cables that are soldered to the wiring pattern of the wiring substrate 121.

The power connector 124 may be inserted into the connection opening through a hole that is formed in the wiring substrate 121. The detailed configuration thereof will also be described later.

Figure 3:
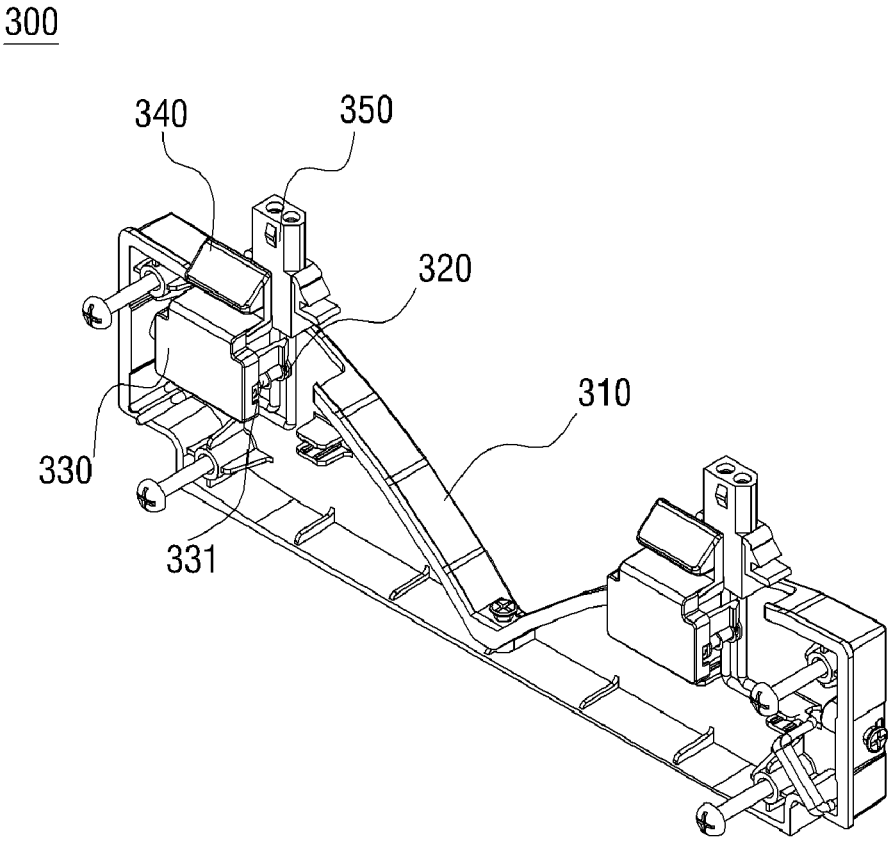
FIG. 3 is a configuration view of a connector unit.
Figure 4:
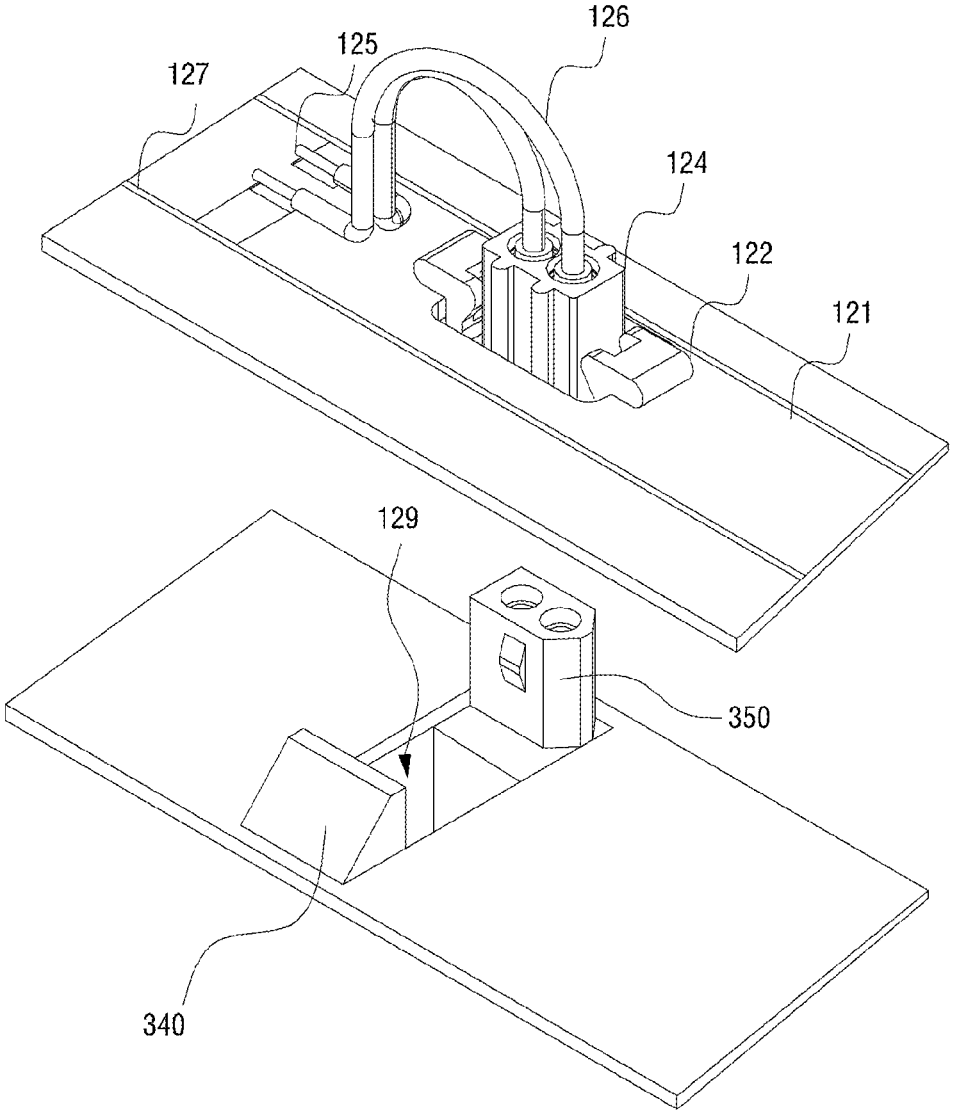
FIG. 4 is a partial perspective view to explain the assembly between a power connector and a lower connector.
Figure 5:
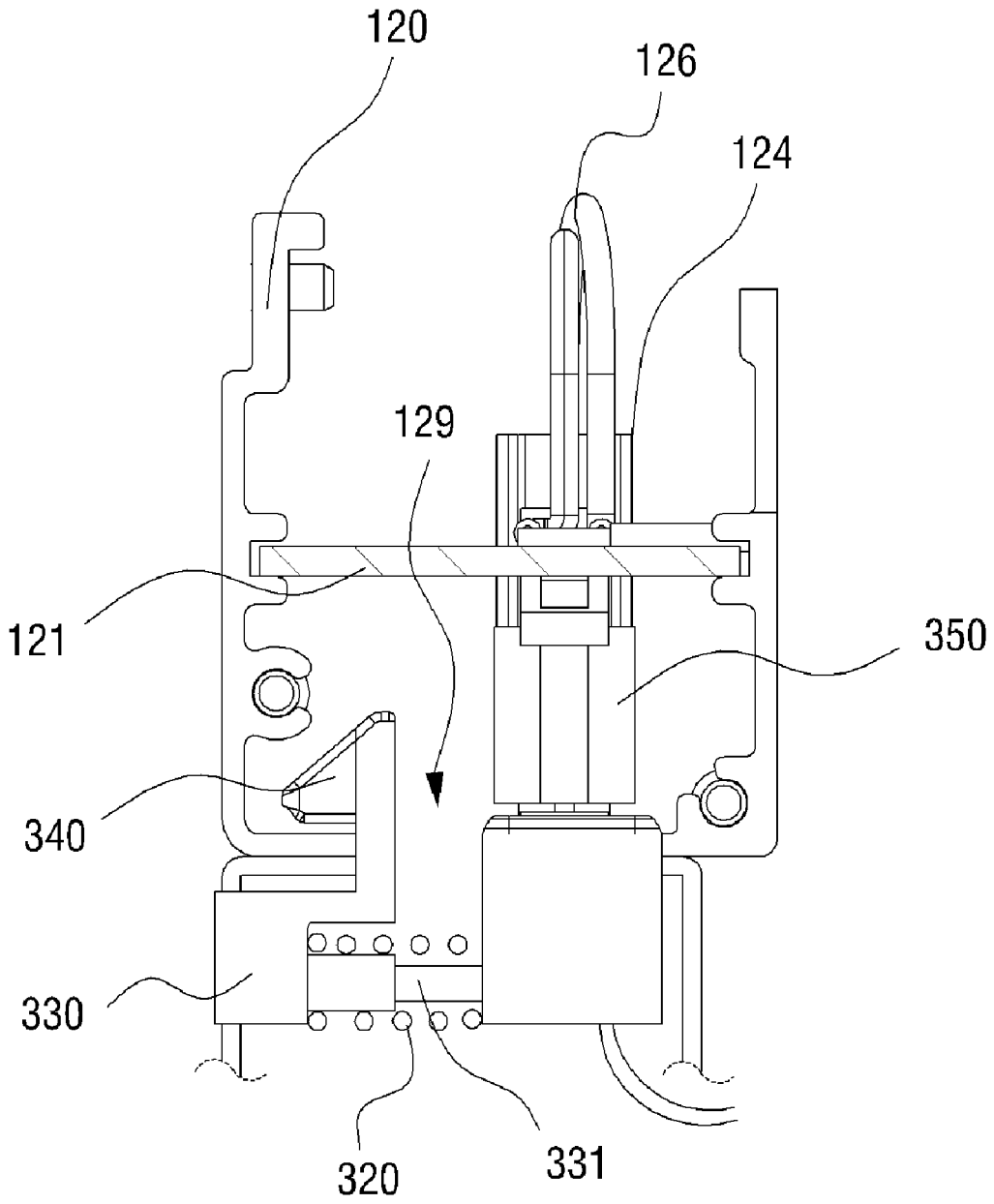
FIG. 5 is a partial sectional view showing the assembly state of a connection frame unit and a connector unit.

FIG. 3 is a configuration view of the connector unit 300, and FIG. 4 is a partial perspective view to explain the assembly between the power connector 124 and the lower connector 350. FIG. 5 is a partial sectional view showing the assembly state of the connection frame unit 120 and the connector unit 300.

Referring to FIGS. 3 to 5, the connector unit 300 is configured to include: a housing 310 that is coupled to both ends of the lighting module unit 200; a spring 320 that is provided on a moving shaft portion 331 of which one end is fixed to the inner side of the housing 310; a pressing plate 330 that is elastically restored to the outside in the state of being pressed by the spring 320 along the moving shaft portion 331; a hitch protrusion 340 that is extended from the upper portion of the pressing plate 330 and that is fixed by being hitched to the connection opening 129 of the connection frame unit 120; and a lower connector 350 that is inserted into the connection opening 129 to be coupled to the power connector 124 in order to thereby supply power to the lighting module unit 200.

The front surface of the pressing plate 330 is exposed to the outside through an opening provided on a portion of the housing 310, so that the user may separate the lighting module unit 200 from the connection frame unit 120 by pressing the pressing plate 330 in order to thereby retract the hitch protrusion 340.

The wiring substrate 121 is extended on the inner surface of the connection frame unit 120 in the longitudinal direction of the connection frame unit 120, and the wiring substrate 121 has a through hole 123 that is formed to correspond to the position of the connection opening 129 so that the power connector 124 may connect to the lower connector 350, which is inserted into the connection opening 129, to then supply power.

As described above, according to the present invention, the through hole 123 is provided in a portion of the wiring substrate 121, and the power connector 124 may be connected through the through hole 123 in order to thereby reduce the size of the device and in order to thereby simplify the configuration thereof, compared to the method in which the connection position of the connector is provided in a separate space outside the substrate.

A connector fixing member 122 for fixing the power connector 124 may be provided in the through hole 123, and an electric cable 126, which are extended from the power connector 124, includes a soldering portion 125 that is soldered to the wiring substrate 121. The soldering portion 125 is connected to a wiring pattern 127. The power of the power supply unit 140 is supplied through the wiring pattern 127 of the wiring substrate 121, and the power of the wiring pattern 127 is transferred to the lower connector 350 through the power connector 124.

Although FIG. 4 illustrates a part of the wiring substrate 121, the wiring substrate 121 is extended through the entire inner surface of the connection frame unit 120. Therefore, since a single substrate is used instead of a separated power connection structure, the configuration can be simplified.

When coupling the lighting module unit 200, to which the connector units 300 are coupled to both ends thereof, to the frame unit 100, the top surface of the hitch protrusion 340 protruding upwards from the connector unit 300 may come into contact with the bottom surface of the connection frame unit 120 to then be moved in the direction to press the spring 320 through pressure acting on the top surface thereof, or the user may press the pressing plate 330 in the direction to press the spring 320 so that the hitch protrusion 340 may be inserted into the connection opening 129 provided on the bottom surface of the connection frame unit 120. At this time, the lower connector 350 is inserted into the connection opening 129 as well.

In the state in which the hitch protrusion 340 is inserted, when the user removes the hand from the pressing plate 330, the hitch protrusion 340 moves outwards by a restoring force of the spring 320 to then be hitched and fixed to the inner side of the bottom of the connection frame unit 120.

At this time, the lower connector 350, which is inserted into the connection opening 129, may be directly connected to the power connector 124, or if the connection between the connectors is not easy, the user may couple the power connector 124 to the lower connector 350 for the connection.

As described above, in the present invention, the lighting module unit 200 can be easily coupled to the frame unit 100 through a one-touch operation.

On the contrary, when separating the lighting module unit 200, the user may press the pressing plate 330, which is exposed to the outside of the connector unit 300, to then release the hitch of the hitch protrusion 340, thereby separating the lighting module unit 200.

As described above, since the lighting module unit 200 can be easily coupled, or detached, even one worker can replace the lighting module unit 200, and the time and cost for maintenance can be reduced.

Although the preferred embodiment of the present invention illustrated in FIGS. 1 and 2 shows the configuration of assembling three lighting module units 200, it is possible to selectively assemble and use one to three lighting module units 200 according to the user's needs or usage of the light.

That is, it is possible to provide a lighting device that has the illuminance to meet a specific usage by using the frame unit 100 of the same design.

Figure 6:
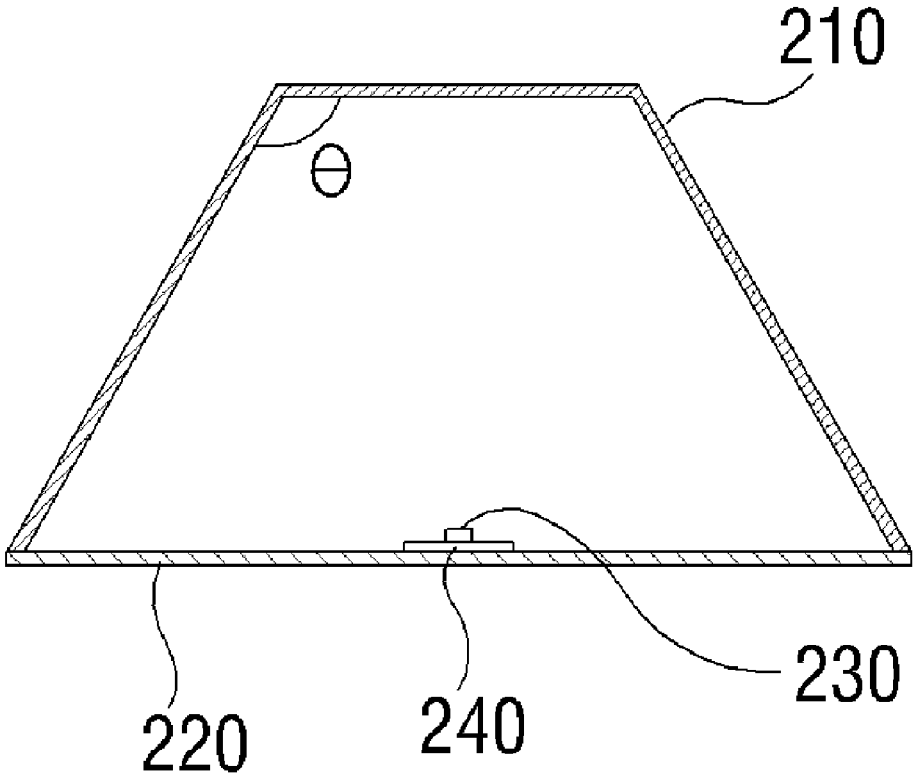
FIG. 6 is a sectional configuration view of an embodiment of a lighting module unit, which can be applied to the present invention.

FIG. 6 is a sectional configuration view of an embodiment of a lighting module unit 200, which can be applied to the present invention.

Referring to FIG. 6, an embodiment of the lighting module unit 200, which can be applied to the present invention, includes: a long case 210 that is extended in one direction to provide a light reflection space therein; a cover 220 that is coupled to the bottom of the case 210; and a substrate 240 that is provided on the upper surface of the cover 220 to be extended in the longitudinal direction of the case 210, and that has a plurality of LEDs 230 mounted thereon.

The case 210 may have: a flat central portion; a side reflection surface 211 that is bent downwards throughout the length; and an end reflection surface 212 that is provided in the width direction. The end reflection surface 212 may be integral with the case 210, or may be bonded, or coupled, to the case 210.

The aforementioned connector units 300 are provided at both ends of the case 210.

The substrate 240 may be provided along the length of the case 210, and a pair of substrates 240, which are separated from each other, may be positioned in the longitudinal direction of the case 210 in order to receive power from the lower connector 350 of the connector unit 300 that are provided at both ends thereof.

This is due to the fact that a supply power drop phenomenon may occur at one side if the substrate 240 is excessively long.

The case 210 has a box-type structure in which the bottom portion thereof is opened, and, in particular, the case 210 has a long shape in one direction in order to replace the conventional fluorescent lamp.

The case 210 may be made of a resin that can reflect light, or may be made of a resin and a reflection sheet that is attached to the inner surface of the resin. The reflection sheet may be attached before processing the case 210, and then may be bent to form the side reflection surface 211 so that the reflection sheet can be easily attached.

A transparent cover 220 may be bonded, or coupled, to the bottom of the case 210. The cover 220 may be light-transmittable without diffusing light. Even though the transparent cover 220 is used, the surface light-emitting can be implemented with remarkably reduced glare because the light is reflected in the reflection space provided by the case 210 and then is emitted through the cover 220.

Therefore, the light efficiency can be improved, and the lighting of the same illuminance as that of the conventional lighting device may be provided while using lower power LEDs.

The cover 220 may be completely light-transmittable, and may use a diffusion plate that slightly diffuses light.

The substrate 240 is attached to the top surface of the cover 220, that is, the substrate 240 is attached to the surface facing the inner upper portion of the case 210. A plurality of LEDs 230 are mounted on the substrate 240, and the substrate 240 is extended in the longitudinal direction of the cover 220.

In particular, as shown in FIG. 6, the substrate 240 is provided in the center of the cover 220 in order to thereby divide the cover 220 into two parts in the width direction. This corresponds to the shape in which two fluorescent lamps are installed side by side, and it looks like the typical fluorescent lamps in order to thereby satisfy even a visually sensitive user without a particular visual dislike.

As described above, the substrate 240 may be comprised of a pair of segments.

The LED 230 emits light upwards to the ceiling not toward the bottom surface in the installed state. The emitted light above is variously reflected in the case 210 and is diffused in order to thereby form the surface light-emitting through the cover 220.

At this time, the side reflection surface 211 of the case 210 is at an obtuse angle (θ) of more than 90 degrees and less than 180 degrees with the flat surface of the upper portion, and, in particular, they are configured to form a sharp bent portion rather than a round shape.

This is because light may be focused on the inside in order to thereby form light and shade in the case of a round shape.

As described above, the present invention diffuses light of the LED 230 in the space and then illuminates by the surface light-emitting through the cover 220. Therefore, since the light efficiency is not sacrificed for the diffusion, the light efficiency may be improved.

Figure 7:
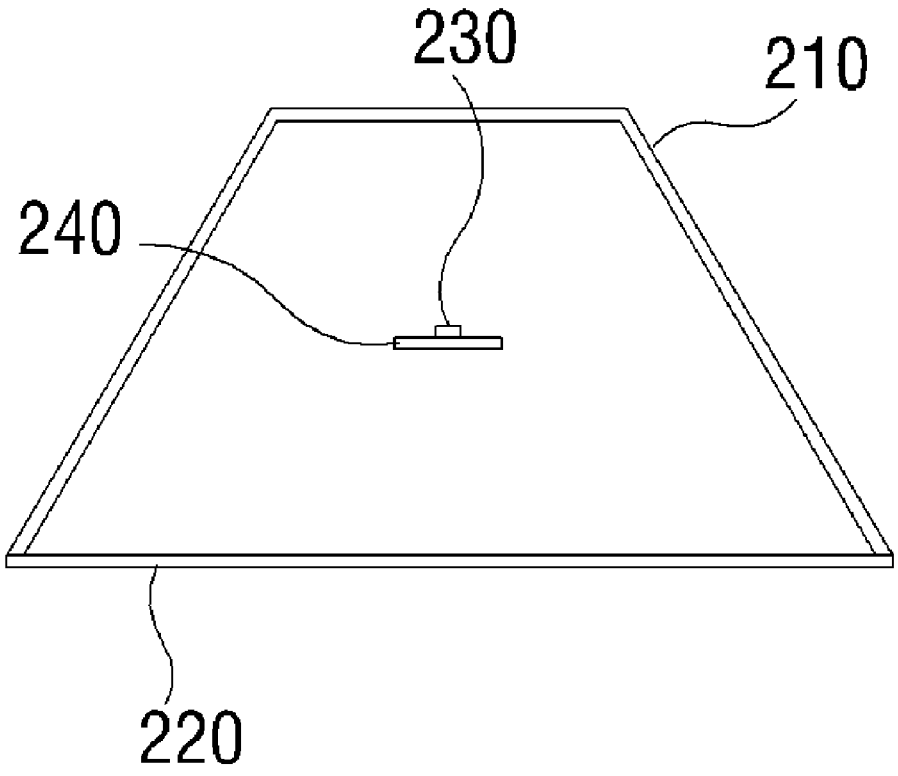
FIG. 7 is a sectional configuration view of another embodiment of a lighting module unit, which can be applied to the present invention.

FIG. 7 is a sectional configuration view of another embodiment of the lighting module unit 200, which can be applied to the present invention.

Referring to FIG. 7, the substrate 240 may be positioned in the space between the cover 220 and the inner side of the case 210 instead of being installed to come into contact with the upper portion of the cover 220. Such arrangement of the substrate 240 may allow the light to also diffuse in the space between the substrate 240 and the cover 220 so that light with a uniform illuminance may be emitted through the entire cover 220 without dividing the cover 220 by the substrate 240.

Figure 8:
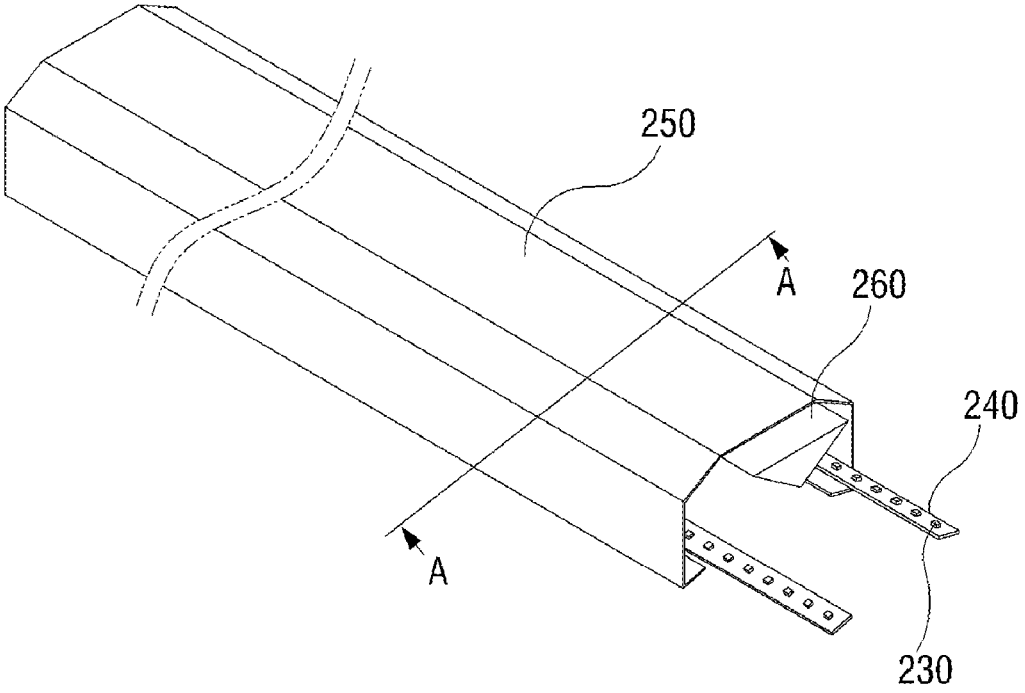
FIG. 8 is an exploded perspective view of another embodiment of a lighting module unit, which can be applied to the present invention.
Figure 9:
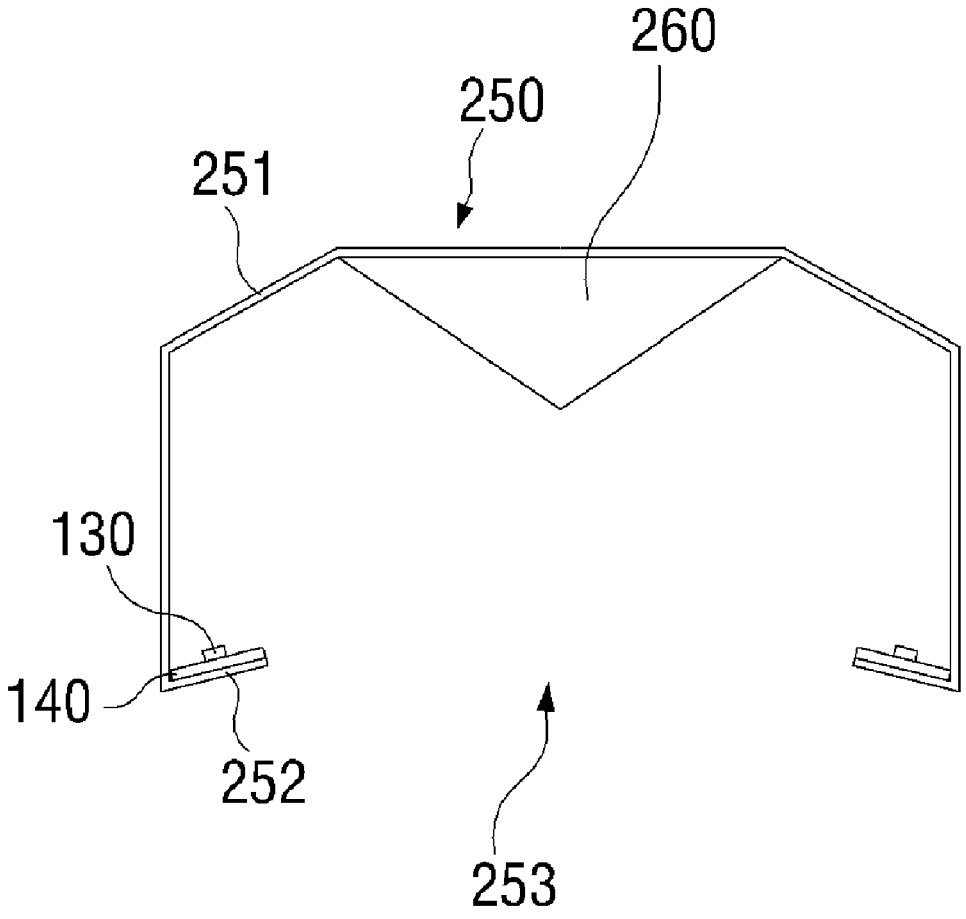
FIG. 9 is a sectional configuration view showing the assembly state viewed in the direction A-A' in FIG. 8.

FIG. 8 is an exploded perspective view of another embodiment of the lighting module unit 200, which can be applied to the present invention, and FIG. 9 is a sectional configuration view showing the assembly state viewed in the direction A-A' in FIG. 8.

Referring to FIGS. 8 and 9, another embodiment of the lighting module unit 200, which is applied to the present invention, is configured to include: a case 250 that has a box shape formed to have a light emitting surface 253 at the bottom thereof, that has an inclined surface 251 in which a part of the inner upper portion is slanted, and that provides slanted seating surface 252 at the ends of both sides of the light emitting surface 253; a reflecting portion 260 that is provided in the center of the inner upper portion of the case 250; and a substrate 240 that is placed on the seating surface 252, and that has a plurality of LEDs mounted thereon.

Hereinafter, the configuration and operation of the LED lighting device described above, according to a preferred embodiment of the present invention, will be described in more detail.

First, the case 250 has a box-type structure in which the bottom thereof is open. In other words, the light emitting surface 253 is formed on the bottom surface, and other portions except for the light emitting surface 253 are enclosed in order to thereby provide a space to allow the light of the LED 230 can be sufficiently reflected therein.

The aforementioned connector units 300 are coupled to both ends of the case 250.

The side of the case 250 is perpendicular to the ground, and a portion of the end of the side is bent toward the inside of the case 250 to form the seating surface 252. The seating surface 252 and the side of the case 250 form an acute angle of less than 90 degrees therebetween.

The seat surface 252 may be provided on two sides that face each other with respect to the light emitting surface 253, or may be formed on one side or on four sides depending on the needs.

The central portion of the inner upper surface of the case 250 is flat, and an inclined surface 251 is extended from the flat central portion to the side. The inclined surface 251 may become lower as it goes to the side.

The reflecting portion 260 is positioned in the central portion of the inner upper surface, which is a flat surface of the case 250. The cross-sectional shape of the reflecting portion 260 is a reverse triangle, and the reflecting portion 260 abuts the inclined surface 251 of the case 250 at the boundary thereof.

That is, the space between the case 250 and the reflecting portion 260 becomes highest at the boundary between the inclined surface 251 and the reflecting portion 260 of the case 250.

The substrate 240, on which a plurality of LEDs 230 are mounted, is installed on the seating surface 252. Accordingly, the light emitting surface of the plurality of LEDs 230 is perpendicular to the seating surface 252, and a light emitted from the LED 230 is directly radiated to the inner side of the case 250.

Figure 10:
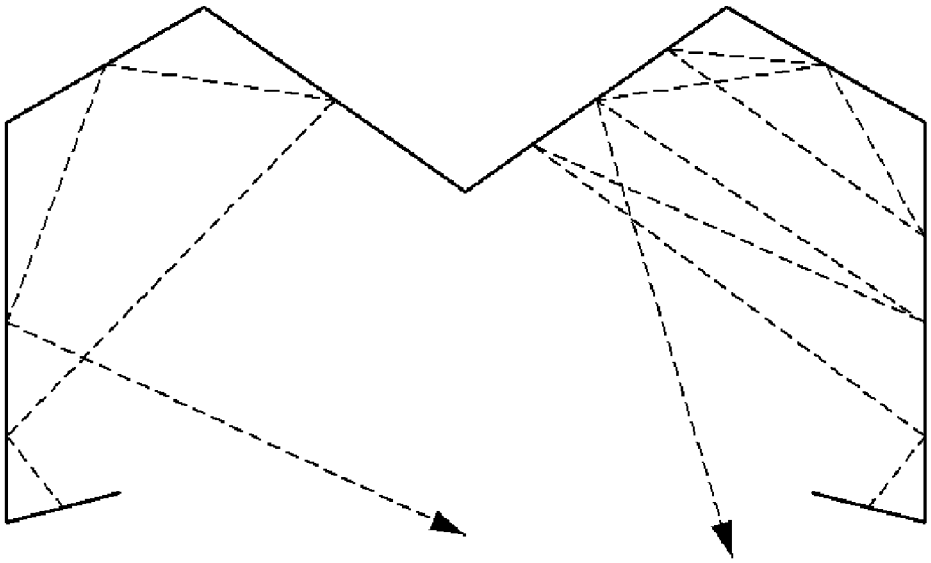
FIG. 10 is a schematic diagram showing the reflection of light in the lighting module unit.

FIG. 10 is a schematic diagram showing the reflection of light in the lighting module unit 200.

Referring to FIG. 10, light of the LED 230 is reflected by the side surface of the case 250, and is repeatedly reflected by the inclined surface 251 and the reflecting portion 260 of the case 250 depending on the reflection angle.

Therefore, the light emitted from the LED 230 is reflected a number of times in the inner space of the case 250 in order to thereby result in a phenomenon in which the light is trapped in the inner space of the case 250.

The trapped light is emitted downward through the light emitting surface 253 to illuminate.

As described above, the lighting module unit 200 confines the light in the space of the case 250 without directly using the light of the LED for illumination, thereby providing surface illumination. Therefore, the glare can be reduced without using lenses or diffusion plates.

As described above, since the diffusion plate is not used, the light efficiency may be improved. Accordingly, the number of LEDs may be reduced based on the provision of the same illumination in order to thereby provide a lower-power lighting device.

In addition, the problems caused by the heat generated in the LED 230 may decrease as well. That is, it is possible to prevent the life of the LED from being shortened due to the generation of the heat even without using a separate heat radiating structure.

Figure 11:
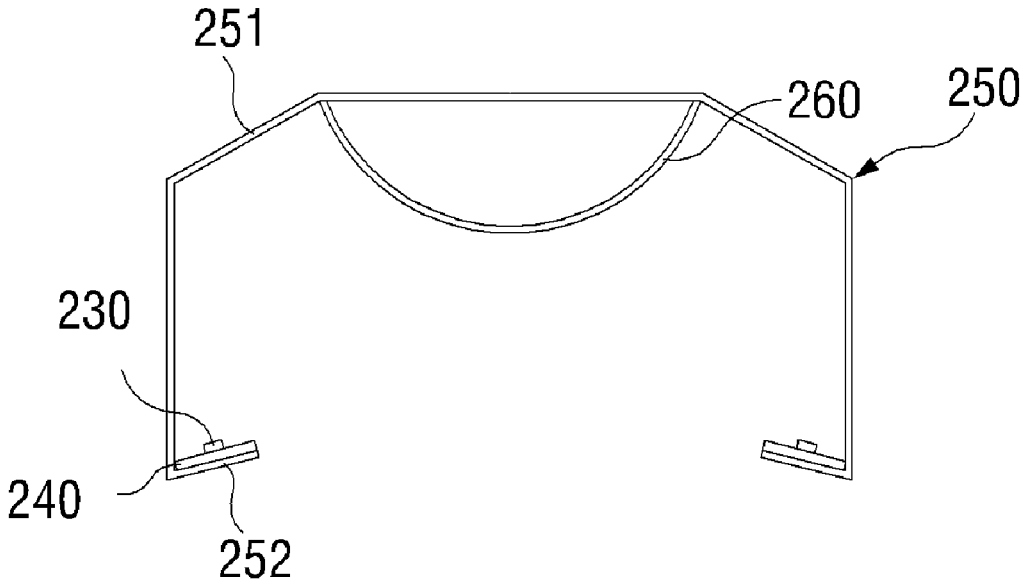
FIGS. 11 and 12 are sectional configuration views showing a lighting module unit, respectively, according to another embodiment of the present invention.
Figure 12:
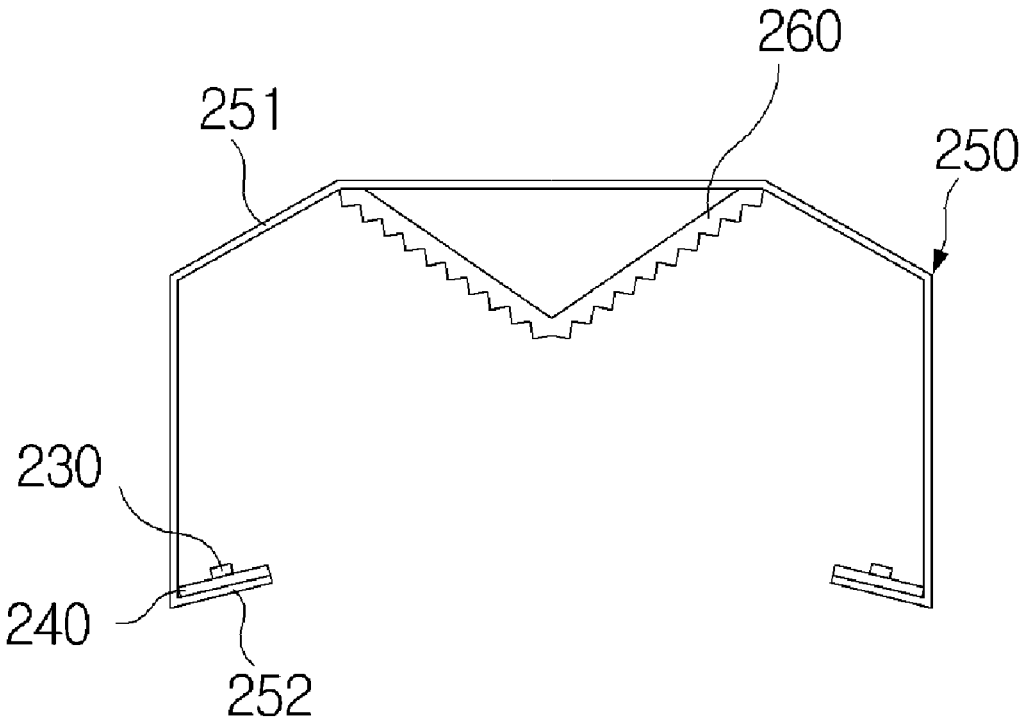

FIGS. 11 and 12 are sectional configuration views showing a lighting module unit, respectively, according to another embodiment of the present invention.

Referring to FIGS. 11 and 12, unlike the embodiment of FIG. 9, the shape of the reflecting portion 260 may be modified to be a semi-circle in the cross-section (FIG. 11), or may be modified to be a reverse triangle that has a plurality of steps or irregularities in order to thereby provide non-uniform illumination.

The reflecting surface of FIG. 11, which has a non-uniform illumination, may be applied to the reflecting portion 260 of FIG. 9.

The reflecting portion 260 of FIG. 11, which has a shape of a semi-circle in the cross-section, and the reverse triangle structure of FIG. 12, which has a plurality of steps, may result in various reflecting angles of the light so that the light may be reflected and diffused more variously and irregularly in the space of the case 250.

The various and irregular reflection of the light may allow the light to more uniformly diffuse so that the light emitted through the light emitting surface 253 may be more similar to the surface light emitting.

Figure 13:
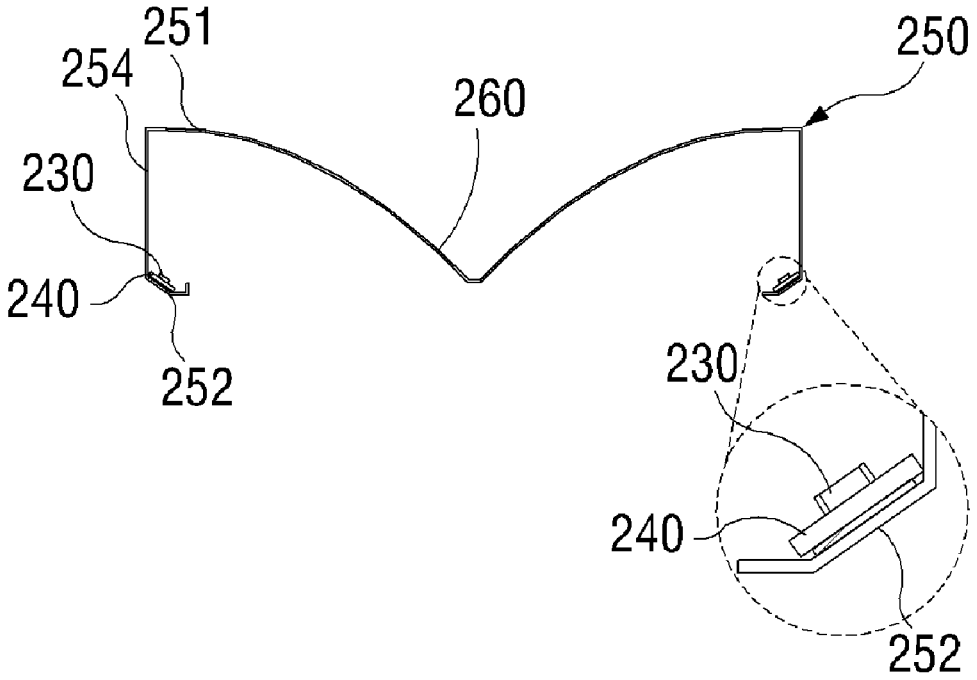
FIG. 13 is a sectional view showing a lighting module unit, according to another embodiment of the present invention.

FIG. 13 is a sectional view showing a lighting module unit, according to another embodiment of the present invention.

Referring to FIG. 13, in the lighting module unit of the present invention, the reflecting portion 260 is formed integrally with the case 250, and the seating surface 252, on which the substrate 240 having the mounted LEDs 230 is placed, is slanted to face the integrally formed reflecting portion 260.

At this time, the inclined surface 251 is a curved surface that is formed between the side 254 and the reflecting portion 260 of the case 250, and, substantially, the inclined surface 251 and the reflecting portion 260 are not clearly sectioned.

In the structure above, a light emitted from the LED 230 is radiated and reflected on the inclined surface 251 and the integrally formed reflecting portion 260, and the reflected light is directly emitted to the outside, or the reflected light is diffused through re-reflection by the side 254 and the inclined surface 251 to then be emitted.

As described above, it is difficult to explain all embodiments of the present invention for the shape of the reflecting portion 260, and any structure in which a light emitted from the LED 230 can be diffused in the inner space of the case 250 may be applied to the present invention.

The present invention is not limited to the embodiments above, and it is obvious to those skilled in the art that the present invention may be variously modified and changed without departing from the technical subject matter of the present invention

The invention claimed is:

1. A detachable LED lighting device comprising:

a lighting module unit that includes a substrate having a plurality of LEDs, and that emits a light according to the supply of power;

a connector unit that is coupled to the lighting module unit and provides a hitch protrusion on an upper portion, and that adopts a lower connector for supplying power to the substrate; and a frame unit that has a connection opening through which the hitch protrusion of the connector unit is inserted from the bottom and then is fixed by being hitched, and that has a power connector for supplying power to the lower connector from an embedded power supply unit, wherein the connector unit further comprises:

a moving shaft portion of one end is fixed to a housing;

a pressing plate that moves along the moving shaft portion, and of which one side is exposed to the outside; and a spring that restores the position of the pressing plate, and wherein the hitch protrusion moves together with the pressing plate.

2. The device according to claim 1, wherein the frame unit comprises:

a central frame in which the power supply unit is embedded; and a connection frame unit that is coupled to the central frame, and that has the connection opening provided at the bottom surface.

3. The device according to claim 2, wherein a pair of connection frames is provided, and each central portion thereof is connected to both ends of the central frame.

4. The device according to claim 2, further comprising: a wiring substrate that is provided inside the connection frame in the longitudinal direction thereof;

a plurality of power connectors that receive power through the wiring substrate; and a plurality of through holes that are formed on the substrate such that each power connector is inserted through the connection opening.

5. The device according to claim 3, further comprising: a wiring substrate that is provided inside the connection frame in the longitudinal direction thereof;

a plurality of power connectors that receive power through the wiring substrate; and a plurality of through holes that are formed on the substrate such that each power connector is inserted through the connection opening.

6. The device according to claim 1, wherein a plurality of substrates are positioned in the longitudinal direction of the lighting module unit.

7. The device according to claim 1, wherein the lighting module unit comprises:

a case that is extended in one direction to provide a light reflection space therein with the bottom surface thereof opened;

a cover that is provided on the bottom of the case, and through which light, which is reflected and diffused in the case, emits; and a plurality of LEDs that emit light between the cover and the inner side of the case so that the light is reflected and diffused inside the case.

8. The device according to claim 7, wherein both sides of the case are bent to form an obtuse angle in the longitudinal direction.

9. The device according to claim 7, wherein the LEDs are mounted on a substrate that comes into contact with the upper portion of the cover, or that is positioned spaced from the same.

10. The device according to claim 1, wherein the lighting module unit comprises:

a case that encloses the lighting module unit excluding a light emitting surface to provide a reflection space to have a predetermined depth, and that has an inclined surface at an inner upper portion;

a seating surface that is formed by a side of the case, which is bent inwardly to the inside of the case; and a substrate that is fixed on the seating surface, and that has a plurality of LEDs mounted thereon.

11. The device according to claim 10, further comprising a reflecting portion that is provided in the center of the inner upper portion of the case, and that allows light of the LED to be reflected and diffused in the reflection space provided by the case by reflecting the light.

12. The device according to claim 11, wherein the reflecting portion is formed to be integral with the case.

* * * * *